United States Patent [19]

Koda

[11] Patent Number: 4,953,740

[45] Date of Patent: Sep. 4, 1990

[54] WASTEBASKET HAVING LID HINGE AND ACTUATING MECHANISM PROTECTOR

[75] Inventor: Walter Koda, Newtown, Conn.

[73] Assignee: Mobil Oil Corporation, New York, N.Y.

[21] Appl. No.: 319,018

[22] Filed: Mar. 6, 1989

[51] Int. Cl.[5] ..... B65D 43/00

[52] U.S. Cl. ..... 220/263; 220/404; 220/908

[58] Field of Search ..... 220/263, 264, 1 T, 17

[56] References Cited

U.S. PATENT DOCUMENTS

| | | | |
|---|---|---|---|
| D. 261,720 | 10/1981 | Brazis | D34/9 |
| D. 265,261 | 6/1982 | Gerber | D32/37 |
| D. 284,320 | 6/1986 | Kubic et al. | D34/1 |
| 2,421,740 | 6/1947 | Birch, Jr. | 248/101 |
| 2,475,125 | 7/1949 | Brownell . | |
| 2,599,362 | 6/1952 | Belsky | 220/337 |
| 3,450,297 | 6/1969 | Clerk | 220/334 X |
| 3,836,037 | 9/1974 | Bass | 220/334 |
| 4,119,240 | 10/1978 | Dumas et al. | 220/263 X |
| 4,164,178 | 8/1979 | Baumann et al. | 100/99 |
| 4,303,174 | 12/1981 | Anderson | 220/263 |
| 4,325,492 | 4/1982 | Kunze | 220/335 |
| 4,361,247 | 11/1982 | Williams | 220/263 X |
| 4,736,915 | 4/1988 | Miller et al. | 220/1 T X |
| 4,753,367 | 6/1988 | Miller et al. | 220/404 |
| 4,763,809 | 8/1988 | Miller et al. | 220/407 |
| 4,776,478 | 10/1988 | Miller et al. | 220/1 T |
| 4,785,964 | 11/1988 | Miller et al. | 220/263 |
| 4,789,078 | 12/1988 | Miller et al. | 220/335 |

*Primary Examiner*—Steven M. Pollard

*Attorney, Agent, or Firm*—Alexander J. McKillop; Charles J. Speciale

[57] ABSTRACT

A wastebasket is provided which includes a container, a lid pivotably mounted to the container, by a hinge, a foot-operated actuating mechanism for opening and closing the lid, and a projection extending from the bottom of the lid to prevent a trash liner secured to the container from interfering with either the hinge or the actuating mechanism. The projection also protects the actuating mechanism from becoming soiled and the lid from bouncing excessively when the lid is opened with too much force.

12 Claims, 8 Drawing Sheets

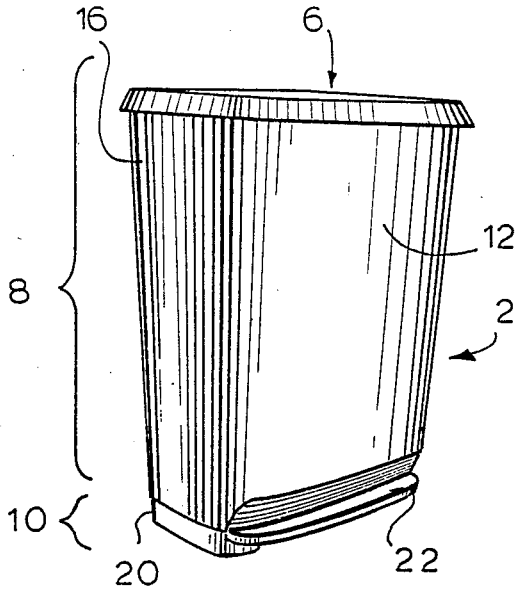
Fig. 1
Fig. 2
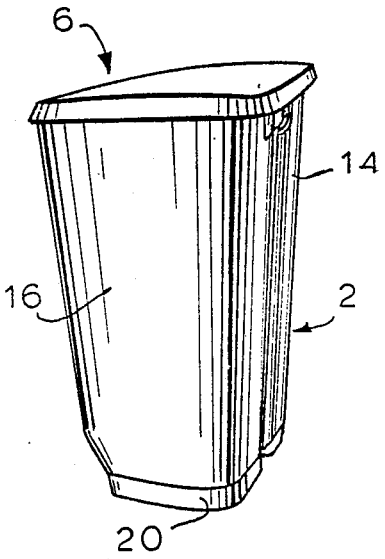
Fig. 3
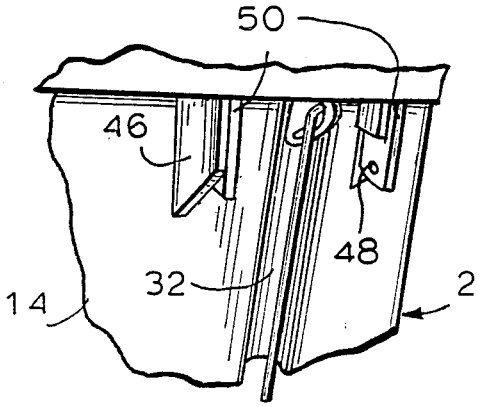
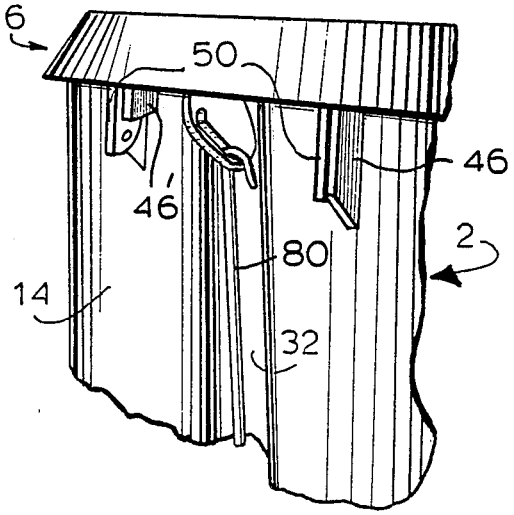
Fig. 4

6
16
20
46
46'
32
80
82
24
14
2
40
44
42
30
28
18
12
36
38
22
A

Fig. 15c
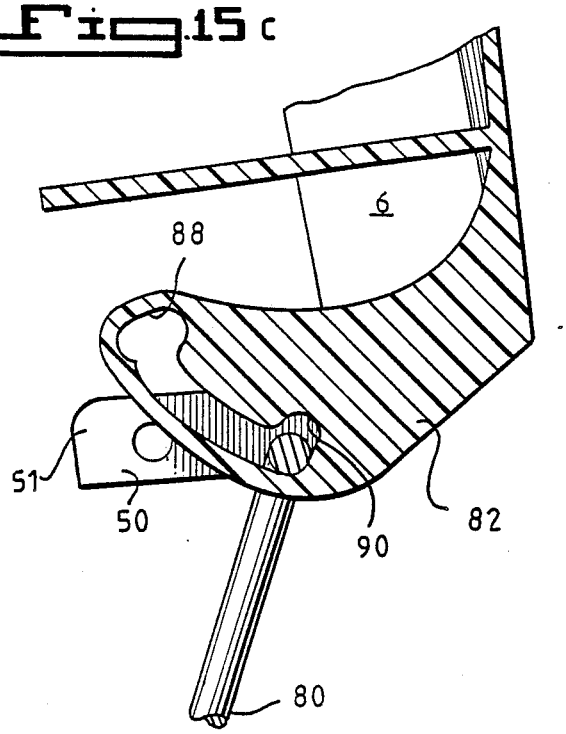
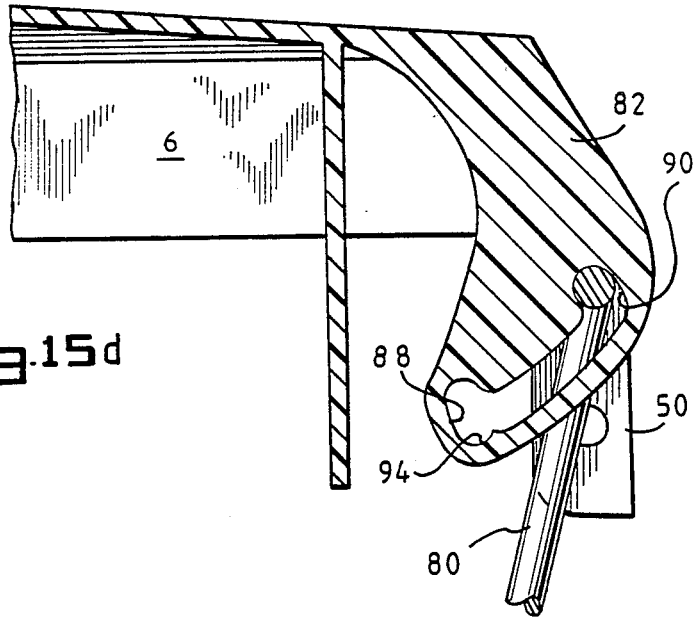
Fig. 15d

WASTEBASKET HAVING LID HINGE AND ACTUATING MECHANISM PROTECTOR

BACKGROUND OF THE INVENTION

1. Field of the Invention

This invention relates to wastebaskets or trash receptacles, and more particularly relates to a wastebasket with a pivoting lid which opens and closes by operation of a foot pedal.

2. Description of the Prior Art

U.S. Pat. No. 2,475,125 to Brownell discloses a foot pedal operated receptacle. One of the primary features of the receptacle disclosed in the Brownell patent is that the lid of the receptacle will open and close in response to actuation of the foot pedal.

This feature of the Brownell receptacle is provided by a straight slot 40 formed in a hinge element 39 joined to the lid. The slot is sloped from the vertical, and has first and second end enlargements 41, 42, one being higher than the other, depending on whether the lid is open or closed. A link member 16 interconnects the hinge element's slot with the foot pedal 15.

When the lid is closed and the foot pedal is stepped on, the link member engages the lower first enlargement and pivots the lid to an open position. When the foot pedal is released, the link member slides down to the second enlargement, which is now the lower of the two. When the foot pedal is stepped on again, the link member now engages the lower second enlargement and pivots the lid in an opposite direction back to the closed position U.S. Pat. No 4,785,964, which is incorporated by reference herein, discloses a wastebasket including a container and a pivotally mounted lid.

The patented wastebasket also includes a mechanism to open and close the lid. The mechanism includes a generally horizontal operating lever (i.e., a foot pedal and its associated parts) mounted on the container, and a depending flange mounted on the lid, which flange has a slot formed through its thickness. The mechanism also includes a link member, such as an elongated metal rod, interconnecting the operating lever with the lid flange.

The slot formed in the lid flange includes an elongated channel, and first and second enlargements situated at opposite ends of the channel. The slot is generally sloped to the vertical so that one enlargement will always be higher than the other, the relative heights of the enlargements reversing when the lid is opened and closed.

The upper end of the link member slides in the slot between the first and second enlargements. When the foot pedal of the operating lever is stepped on and the lid is in the closed position covering the top opening of the container, the link member engages the lid flange at the first enlargement, which is lower than the second, and exerts a force on the flange to pivot the lid to the open position. When the lid is in the open position, the second enlargement is now the lower one. Releasing the foot pedal allows the upper end of the link member to slide by gravity to the lower second enlargement Stepping on the foot pedal while the lid is in the open position causes the upper end of the link member to engage the lid flange at the second enlargement and exert a force on the flange to pivot the lid in the opposite direction to the closed position The foot pedal of the operating lever extends substantially across the entire front of the wastebasket. The foot pedal and operating lever are reinforced by ribs on their undersides so that if the foot pedal is stepped on at any point over its width, it will open or close the lid.

Also, the foot pedal is exposed but recessed inwardly of the wastebasket's general outline, and the link member is substantially disposed within a channel formed in the back of the wastebasket. Thus, neither the foot pedal nor the link member protrudes to any substantial degree from the wastebasket, providing the wastebasket with a slim line and aesthetically pleasing appearance, and providing protection for the link member.

If used incorrectly, the wastebasket lid disclosed in U.S. Pat. No. 4,785,964 may tend to remain open if the plastic trash bag becomes caught in the hinge mechanism. The lid may also bounce if opened with excessive force since there is nothing to dampen it. In addition, the lid actuating mechanism may become soiled if material runs down the lid while in the open position.

SUMMARY OF THE INVENTION

It is accordingly an object of the invention to provide a wastebasket including a container, a lid, a hinge connecting the lid to the container, and means for preventing a trash bag mounted to the container from interfering with the operation of the hinge.

It is another object of the invention to provide such a wastebasket including means for damping movement thereof about the hinge when the lid is opened.

Still another object of the invention is to provide a wastebasket including means for protecting a lid actuating mechanism from being soiled.

In accordance with these and other objects of the invention, a wastebasket as described above is provided which includes a projection extending from the bottom surface of the lid and over the top surface or rim of the container. The projection preferably engages the rim when the lid is open to provide frictional damping if the lid is opened with excessive force. It is also preferably positioned above the lid actuating mechanism when the lid is open to prevent the latter from becoming soiled.

A plastic liner or trash bag is secured to the container by folding its edges over the rim of the container or, if the container is so equipped, over a retainer ring which is pivotally secured to the container. In either event, the projection prevents the bag from being folded completely over the back rim of the container where it could interfere with the hinge.

A preferred form of the wastebasket, as well as other embodiments, objects, features and advantages of this invention, will be apparent from the following detailed description of illustrative embodiments thereof, which is to be read in connection with the accompanying drawings.

BRIEF DESCRIPTION OF THE DRAWINGS

FIG. 1 is a front perspective view of a wastebasket formed in accordance with the present invention.

FIG. 2 is a side perspective view of the wastebasket shown in FIG. 1.

FIG. 3 is a rear perspective view of a portion of the wastebasket.

FIG. 4 is a rear perspective view of a portion of the wastebasket taken from a different angle than that of FIG. 3.

FIGS. 15*a* through *d* are sectional views of the lid movement actuation flange of the wastebasket, illustrating in sequence its operation in opening and closing the lid.

DETAILED DESCRIPTION OF THE PREFERRED EMBODIMENTS

Figures 5, 6, 7, 8:
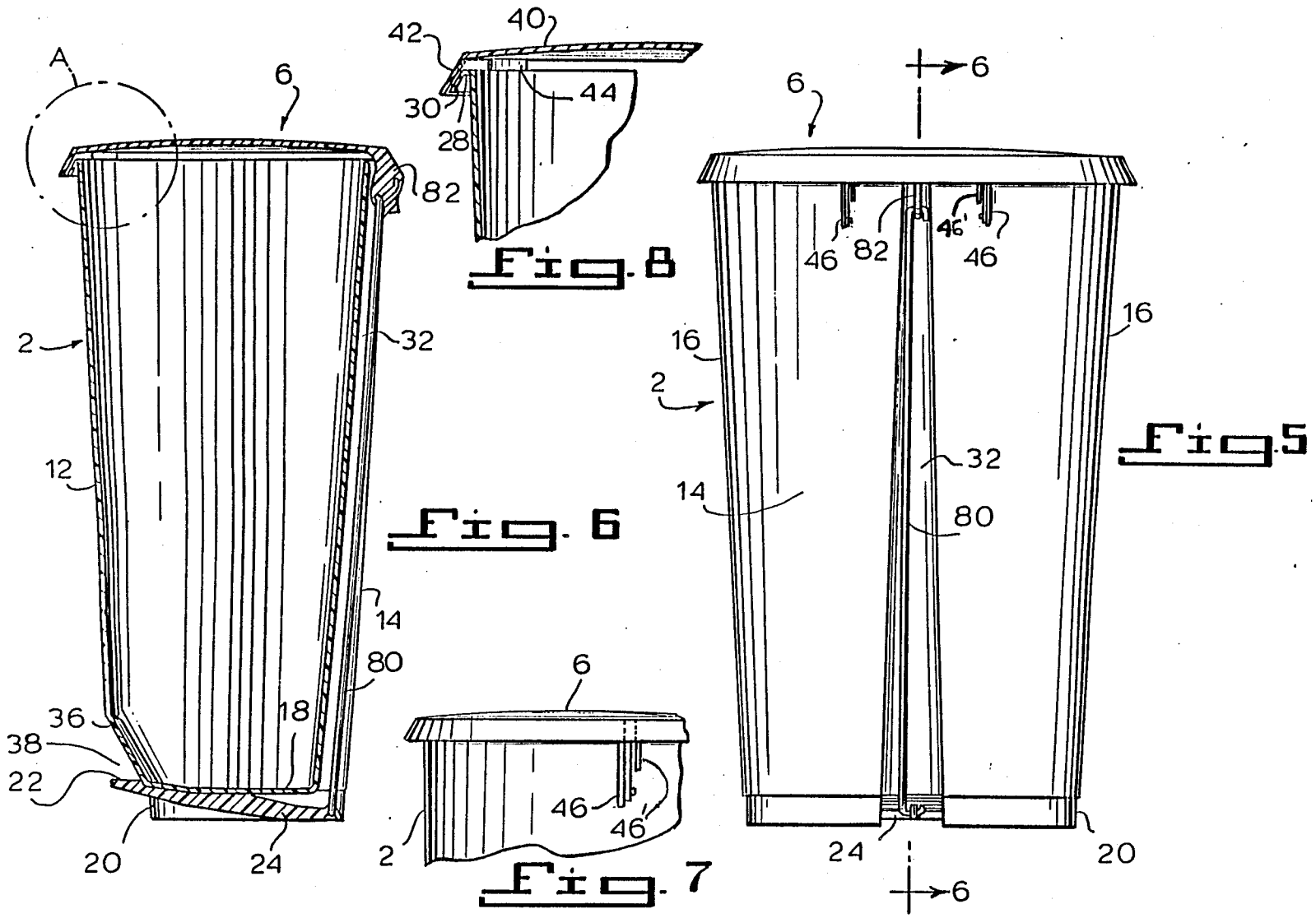
FIG. 5 is a rear elevational view of the wastebasket shown in FIG. 1.
FIG. 6 is a sectional view of the wastebasket, taken along line 6—6 of FIG. 5.
FIG. 7 is a rear elevational view of a portion of the wastebasket.
FIG. 8 is an enlarged view of that portion of the wastebasket shown in the circle A of FIG. 6.

Referring initially to FIGS. 1 through 10 of the drawings, it will be seen that a wastebasket formed in accordance with the present invention basically includes a container 2 having an open end 4, and a lid 6 pivotally mounted on the container to cover and uncover the open end.

In its preferred form, the container 2 has an overall rectangular shape when viewed from above, and includes an upper section 8 and a lower section 10 on which the upper section 8 rests. The upper section 8 consists of a front wall 12, a rear wall 14, two opposite lateral walls 16, and a bottom wall 18, all of which are joined together at substantially rounded corners. The walls 12–16 of the upper section taper slightly inwardly from top to bottom at about a 3° angle from the vertical.

The lower section 10 includes parallel side walls 20 set inwardly from the walls of the upper section 8. As will be described, lower section 10 provides an interior area for mounting the foot pedal 22 and operating lever 24 for opening and closing the lid.

The upper edges of the walls 12–16 of the container are joined together to form a rim 26. Preferably, as shown in FIG. 8, the rim 26 is downturned on the outside of the container, and includes a flat horizontal portion 28 and a downwardly sloping edge portion 30 extending from the horizontal portion The downturned rim 26 strengthens the container at its open end 4.

Figure 10:
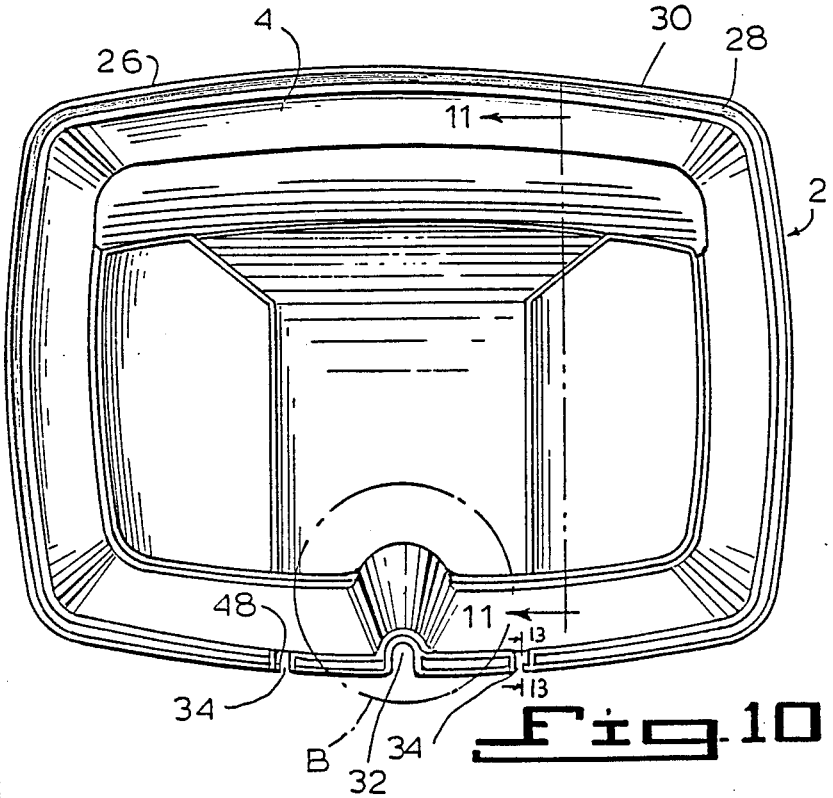
FIG. 10 is a top plan view of the wastebasket without the lid.
Figure 11:
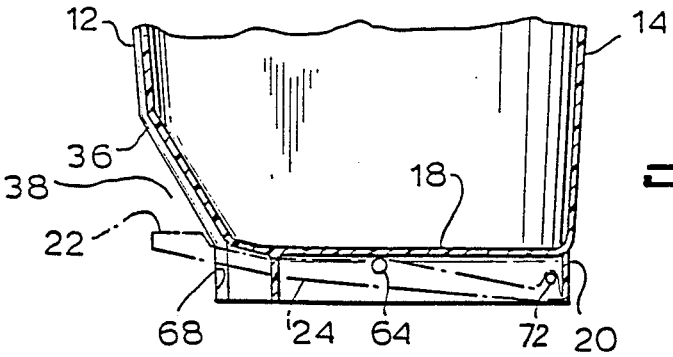
FIG. 11 is a sectional view of the lower portion of the wastebasket, taken along line 11—11 of FIG. 10.
Figure 12:
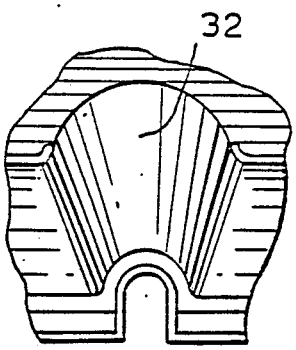
FIG. 12 is an enlarged view of that portion of the wastebasket shown in circle B of FIG. 10.
Figure 13:
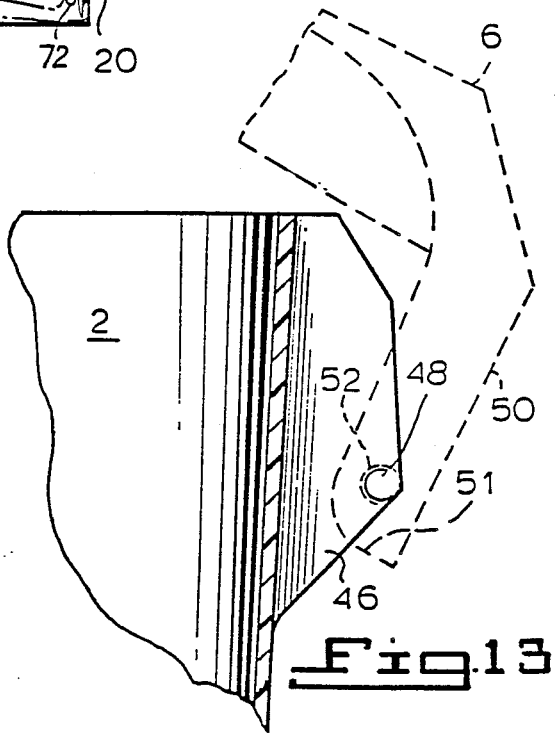
FIG. 13 is a sectional view of a portion of the wastebasket, taken along line 13—13 of FIG. 10, with the lid shown in dashed lines.
Figure 14:
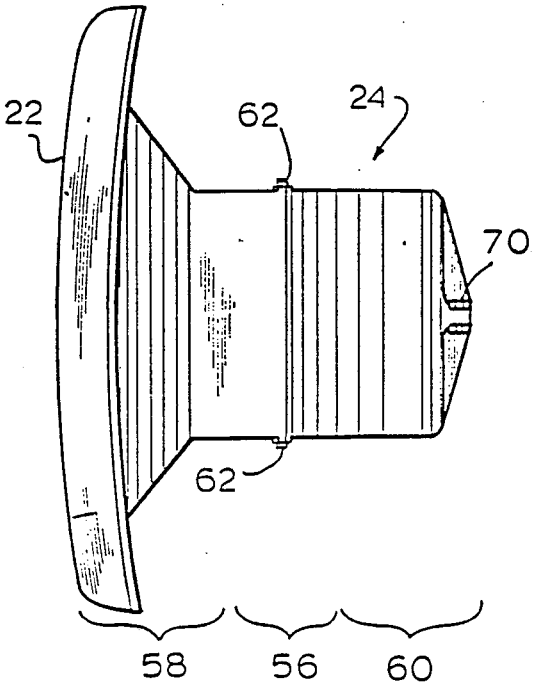
FIG. 14 is a top plan view of the foot pedal portion of the wastebasket.

As shown in FIG. 10, the container rim 26 extends continuously about the open end of the container except where it partially defines a channel 32, and in two other places where it terminates to define slots 34. The function of the channel 32 and slots 34 will be described in detail later.

The front wall 12 of the container includes an inwardly sloping lower wall 36 which, as shown more clearly in FIG. 6, defines a recess 38 across the entire front of the wastebasket for receiving the foot pedal 22. The slope and height of the lower wall 36 and the outward length of the foot pedal 22 are chosen so that the foot pedal does not substantially extend beyond the plane of the front wall 12. With this configuration, the foot pedal 22 of the wastebasket does not protrude beyond the general outline of the wastebasket, and yet is exposed for easy access.

The lid 6 of the wastebasket is substantially rectangular in shape to conform to the overall shape of the container 2. It includes a generally flat or slightly convex top wall 40, a flat, rectangular projection 41 extending substantially perpendicularly from the bottom surface of the top wall 40, and a rim 42 which extends about the periphery of the top wall 40 and slopes downwardly and outwardly from the top wall. The lid rim 42 substantially parallels the edge portion 30 of the container rim and extends to or slightly below the edge of the container rim 26 so that it can mount closely on the container and hide the container rim from view when the lid is in the closed position covering the container's open end 4.

Figure 9:
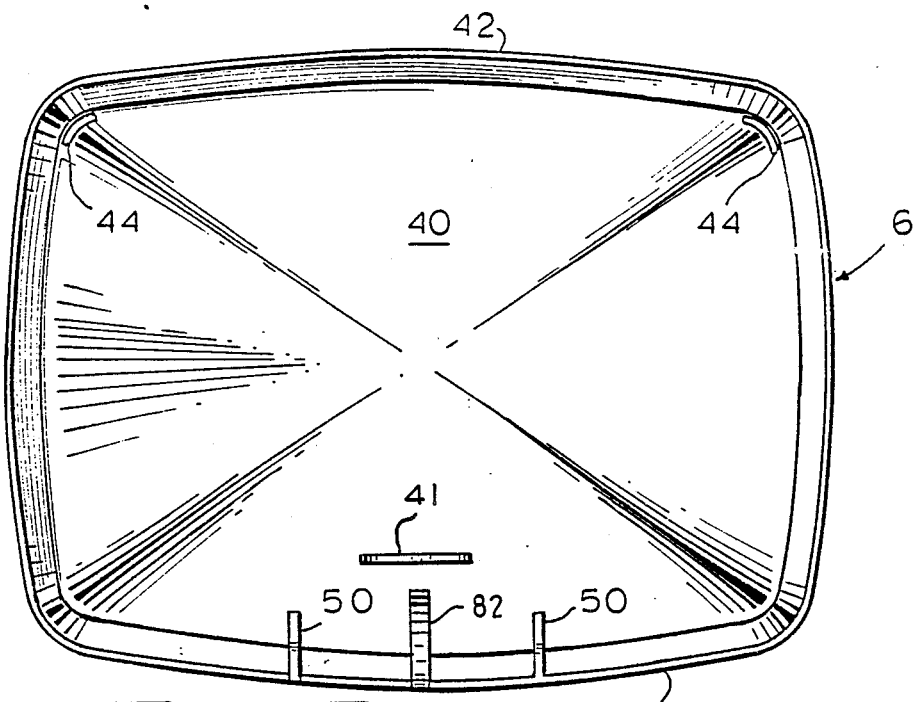
FIG. 9 is a bottom plan view of the lid of the wastebasket.

The lid 6 further includes two support members 44 which project downwardly from the underside of the lid's top wall 40, as shown in FIGS. 8 and 9. The support members 44 engage the horizontal portion 28 of the container rim at the two front corners of the container, and function to support the lid on the rim 26 of the container.

As mentioned earlier, the lid 6 is mounted on the container 2 and is pivotable between a closed position, covering the container's open end 4, and an open position, where it is in a substantially upright, vertical disposition uncovering the open end. The structure for mounting the lid on the container is shown in FIGS. 3–5, 7, 9 and 10 and will now be described.

Two pairs of parallel, spaced apart ribs 46, 46′ are provided on the container. The ribs 46, 46′ of each pair straddle a corresponding slot 34 formed in the container rim and extend outwardly from the rear wall 14 of the container and downwardly from the container rim 26. A pin 48 extends from one rib 46 of each pair partially across the gap between the ribs, providing enough space between the free end of the pin 48 and the adjacent rib to allow a hinge element of the lid to be inserted between them.

The lid includes a pair of spaced apart, somewhat flexible hinge elements 50 formed as planar, depending members joined to the top wall 40 and rim 42 of the lid. Each hinge element 50 is formed with an aperture 52 through its thickness, which aperture receives a corresponding mounting pin 48. The lid is mounted on the container by force-fitting the hinge elements 50 between the ribs 46, 46′ of the container and onto the mounting pins 48. One set of ribs 46′ is shorter in length than the other to allow the person installing the lid to bend the end of each hinge element 50 inwardly to align the respective apertures with the mounting pins 48. The hinge elements may be deflected at their ends a distance exceeding the widths of the slots 34, thereby facilitating the mounting of the lid. Portions of the lid hinge elements 50 are received in the slots 34 of the container rim. The rim slots 34 allow the lid to be seated closely on the container rim 26 without the lid hinge elements interfering with the fit of the lid on the container. Each hinge element 50 further includes a stop surface 51, which surface can engage the rear wall 14 of the container to keep the lid in an open, substantially upright position.

The wastebasket of the present invention is further provided with a foot operated pedal mechanism for both opening and closing the lid. This structure is shown generally in FIG. 6 and in greater detail in FIGS. 11–15. U.S. Pat. No. 4,785,964 also shows and describes this type of structure.

A generally horizontally disposed operating lever 24 is mounted in the lower section 10 of the wastebasket. The operating lever 24 includes an intermediate portion 56, and front and rear portions 58, 60 disposed on opposite sides of the intermediate portion The operating lever 24 is generally planar in its overall configuration, although the front portion 58 and rear portion 60 are slightly displaced from the intermediate portion 56 at higher and lower levels, respectively.

The operating lever 24 is pivotally mounted on the container. For this purpose, a pair of mounting pins 62 are provided on the lever at its intermediate portion 56, and extend outwardly from opposite lateral sides of the lever. The mounting pins 62 are received in corresponding apertures 64 formed through the thickness of opposite walls 20 of the lower section 10. In this way, the operating lever is held in place at the bottom of the container.

The front portion 58 of the operating lever includes a foot bar or pedal 22. The foot pedal 22 is formed as a flat elongated member which is joined to the intermediate portion 56 through a slot 68 formed on a front wall of the lower section 10. As mentioned previously, the foot pedal 22 is disposed on the front wall 12 of the container and recess 38 defined by the sloping lower wall 36.

The foot pedal 22 has a width which allows it to extend substantially across the entire width of the front wall 12, as opposed to many conventional, pedal operated trash receptacles that have foot sized pedals. The wide foot pedal or foot bar 22 of the present invention makes it more convenient for the user to open and close the wastebasket lid, as he does not have to stretch or take particular aim to actuate the foot pedal 22 as he would with the conventional wastebaskets described above.

The rear portion 60 of the operating lever includes a free end formed with an upturned flange 70. An aperture 72 is formed through the thickness of the flange 70 and, as will be seen, is provided for receiving one end of a linkage interconnecting the operator lever 24 with the lid 6.

The operating lever 24 pivots in seesaw-type fashion, with the mounting pins 62 at the intermediate portion acting as a fulcrum, whenever pressure is exerted on the foot pedal 22 or released from the pedal. One of the advantages of the present invention is that pressure may be exerted at any point on the foot pedal 22 to actuate the mechanism which opens and closes the lid. Thus, the foot pedal and operating lever must be substantially rigid, and not flex under the pressure of one's foot or the opposing weight of the lid pivoting mechanism, and yet their design must meet desired design criteria of making a substantial portion of the wastebasket from plastic materials and by molding techniques.

To meet these criteria, the underside of the foot pedal 22 and front portion 58 of the operating lever is formed with a plurality of criss-crossed, diagonal stiffening ribs as shown and described in said U.S. Pat. No. 4,785,964.

A linkage is provided between the operating lever 24 and the lid 6 to transmit the pivotal movement of the lever to the lid. Preferably, the linkage is an elongated metal rod 80 having opposite hooked ends. One end of the rod 80 is received in the flange aperture 72 of the operating lever, and the other end is joined to the lid, as will be described.

The rod 80 is mostly housed in the channel 32 formed in the rear wall of the container, which channel extends vertically between the rim 26 and the lower section 10. As seen in FIG. 6, the rod 80 does not protrude from the general periphery of the wastebasket This not only provides the wastebasket with an aesthetically pleasing appearance, but also protects the rod linkage from damage and allows the wastebasket to be used in a confined space and closer to a wall without interfering with the lid opening and closing mechanism.

As shown in FIGS. 6 and 15*a–d*, the lid 6 is formed with a plate-like flange 82 depending from the top wall 40 and rim 42 of the lid and situated generally at the lid's pivot axis. The flange 82 is also disposed vertically in alignment with the channel 32 of the container so that it is in proper position for connection with the rod linkage 80.

The flange 82 defines an elongated slot 84 which is formed through its thickness. The slot 84 is sloped to the vertical in one direction when the lid is closed (see FIG. 15*a*), and is sloped to the vertical in an opposite direction when the lid is open (FIG 15*c*).

Figure 15A:
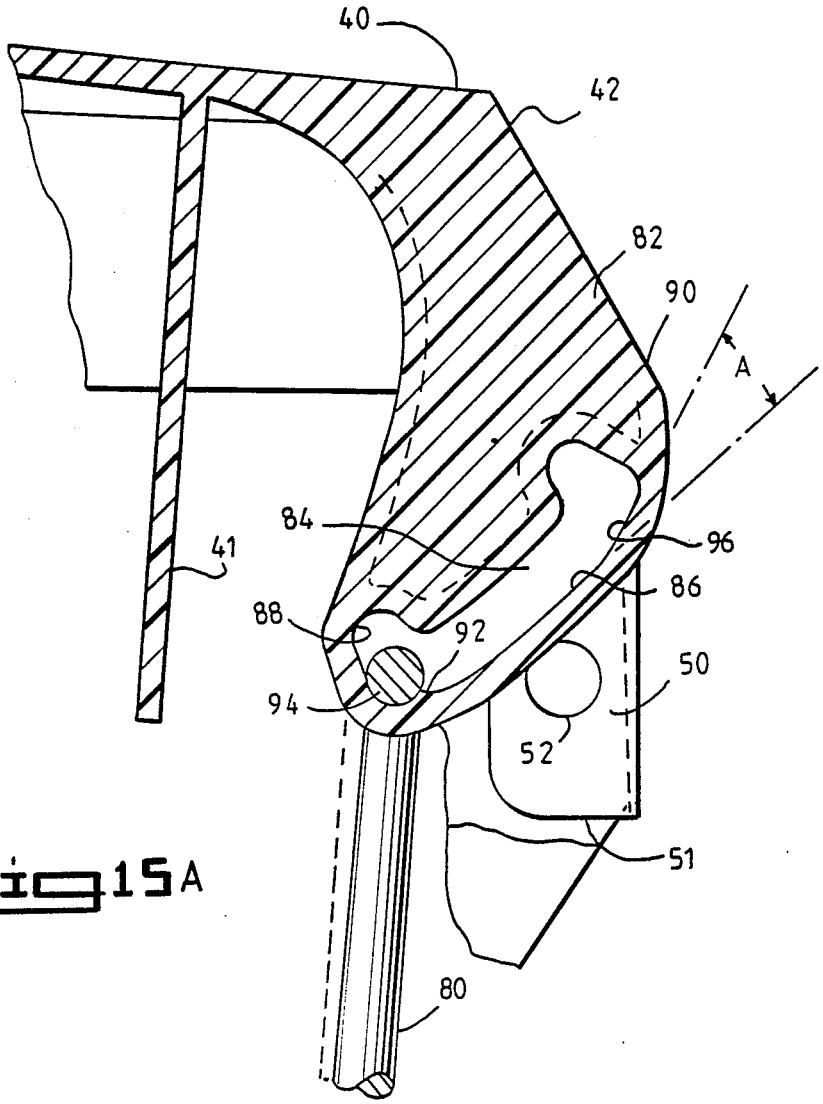

As more specifically shown in FIG. 15*a*, the slot 84 is formed with a central channel 86 and two enlargements 88, 90 disposed at opposite ends of the channel. The enlargements 88, 90 extend upwardly in the lid flange beyond the transverse width of the channel 86, providing the slot with a slight concave or U-shaped configuration. One enlargement 88 is situated more inwardly toward the container's rear wall and on the inner side of the lid pivot axis when the lid is in the closed position. The other enlargement 90 is situated more outwardly of the rear wall and on the outer side of the pivot axis when the lid is in the open position.

The lid flange slot 84 receives the upper hooked end of the rod linkage 80. The slot 84 is dimensioned so that the upper end of the rod fits into either enlargement 88, 90 and may freely slide through the channel 86 of the slot between the enlargements.

The combined weight of the rod linkage 80 and rear portion 60 of the operating lever (i.e., rearward of the lever mounting pins 62) is chosen to be greater than the weight of the foot pedal 22 and forward portion 58 of the operating lever (i.e., forward of the mounting pins). In this way, the foot pedal 22 will rise freely when pressure on the pedal is released, and the upper end of the rod linkage 80 will slide freely by gravity from whichever enlargement is higher, through the channel 86 and into the lower enlargement Means (not shown) may be mounted to the flange 82, such as a pivotably mounted weight, for urging the rod linkage 80 downwardly.

The operation of the lid opening and closing mechanism described above can be explained in the sequence illustrated by FIGS. 15*a* through *d*. FIG. 15*a* shows the lid 6 in a closed position covering the container opening. When the lid is in this position, the slot 84 is sloped inwardly, with the inner enlargement 88 being lower than the outer enlargement 90. The rod 80 rests in the inner enlargement 88, and the foot pedal 22 is in a raised condition on the front wall of the container.

Figure 15B:
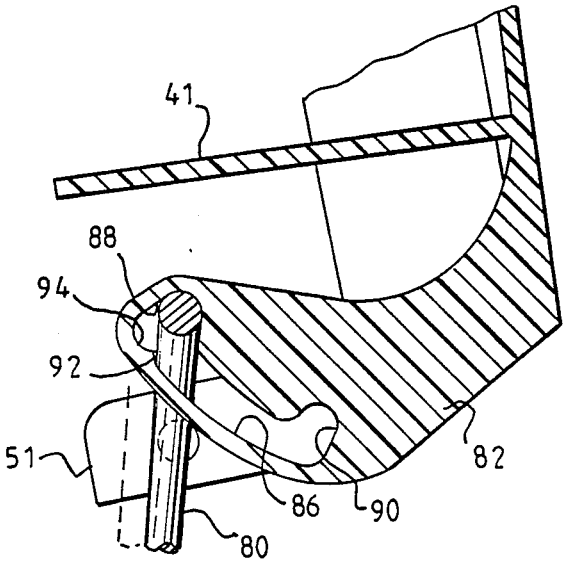

When the foot pedal 22 is stepped on, the operating lever 24 pivots to raise the rod 80 into the top of the inner enlargement 88. The rod exerts a force on the lid flange 82 sufficient to raise the lid from the container and pivot it about the lid mounting pins 48 to a substantially vertical, upright position uncovering the container opening, as shown in FIG. 15*b*. In this position, the inner enlargement 88 is now higher than the outer enlargement 90 and the projection 41 is positioned over the rod 80 and lid flange 82.

When pressure on the foot pedal 22 is released, the rod 80 slides from the now higher, inner enlargement 88, through the channel 86 and into the lower out enlargement 90, as shown in FIG. 15*c*, and the foot pedal 22 returns to its raised state due to the greater weight of the rear portion 60 of the operating lever and the rod 80.

If the foot pedal 22 is stepped on again, the upper end of the rod linkage 80 will be raised by the operating lever into engagement with the lid flange 82 at the top of the outer enlargement 90 The rod 80 exerts a force on the lid to swing about the pivot axis in the opposite direction to a closed position covering the container, as shown in FIG. 15*d*. The slope of the flange slot 84 has now reversed and the outer enlargement 90 is higher Releasing the foot pedal 22 will allow it to rise and will let the rod 80 slide from the higher outer enlargement 90 through the channel 86 to the lower inner enlargement 88.

In order to protect lid pivoting mechanism, substantially the entire operating lever, including its flange 70 to which the rod linkage 80 is pivotally connected, is housed within the lower section 10 of the container, and the rod linkage 80 resides almost entirely within the channel 32.

The flange 70 is situated inwardly of the container and the rod 80 is always tilted away from the container.

To ensure that the rod linkage moves in the desired direction during the lid opening and closing operation, the lid flange 82 is particularly shaped to help guide the rod 80. More specifically, the lid flange includes a ridge 92 which protrudes into the slot 84 at its lower side between the inner enlargement 88 and the channel 86. The ridge 92 defines a slight constriction in the channel.

Without such a ridge 92 for guiding the rod, when pressure is gradually exerted on the foot pedal 22 to open the lid so that the rod 80 rises rather slowly, it is possible for the rod to slip out of the inner enlargement 88 and into the channel 86 rather than properly engage the lid flange at the top of the inner enlargement. The ridge 92, on the other hand, helps direct the rod 80 towards the top of the inner enlargement 88, and the constriction it presents between the enlargement 88 and channel 86 helps prevent the rod from slipping in to the channel under the conditions described above. The ridge 92 also provides a well defined, curved seat surface 94 at the bottom of the inner enlargement 88 below that portion of the lid flange it is to engage when the foot pedal is actuated.

It has also been found that the rod 80 will correctly slide into place within the outer enlargement 90 and will be properly directed towards the top of the enlargement when the foot pedal is stepped on if a portion 96 of the channel at the entrance to the enlargement 90 is turned upwardly at an angle A from the rest of the channel 86. The preferred angle A of slope at channel portion 96 is about 15° to 20° and is optimally set at 18°. With such an upturned channel portion 96, the rod 80 will be properly guided as it slides between the channel and the outer enlargement 90, and will be directed to engage the lid flange at the top of enlargement 90.

As mentioned previously, one of the objects of the invention is to prevent a plastic trash bag or liner from being caught within the hinge mechanism which secures the lid 6 to the container 2. A trash liner is Mounted to the container by folding it over the edges thereof while the lid is in the Open position as shown in FIG. 15*c*. While in this position, the projection 41 overlies and preferably contacts the rim 26 of the container. The liner accordingly cannot be folded over this portion of the rim or work its way down to the hinge mechanism (46–50) or the lid actuating assembly (80,82).

The projection 41 also provides the added benefits of protecting the lid actuating assembly from being soiled from the liquid running down the lid, and reducing the bouncing of the lid when opened with a greater than necessary force.

Figure 16:
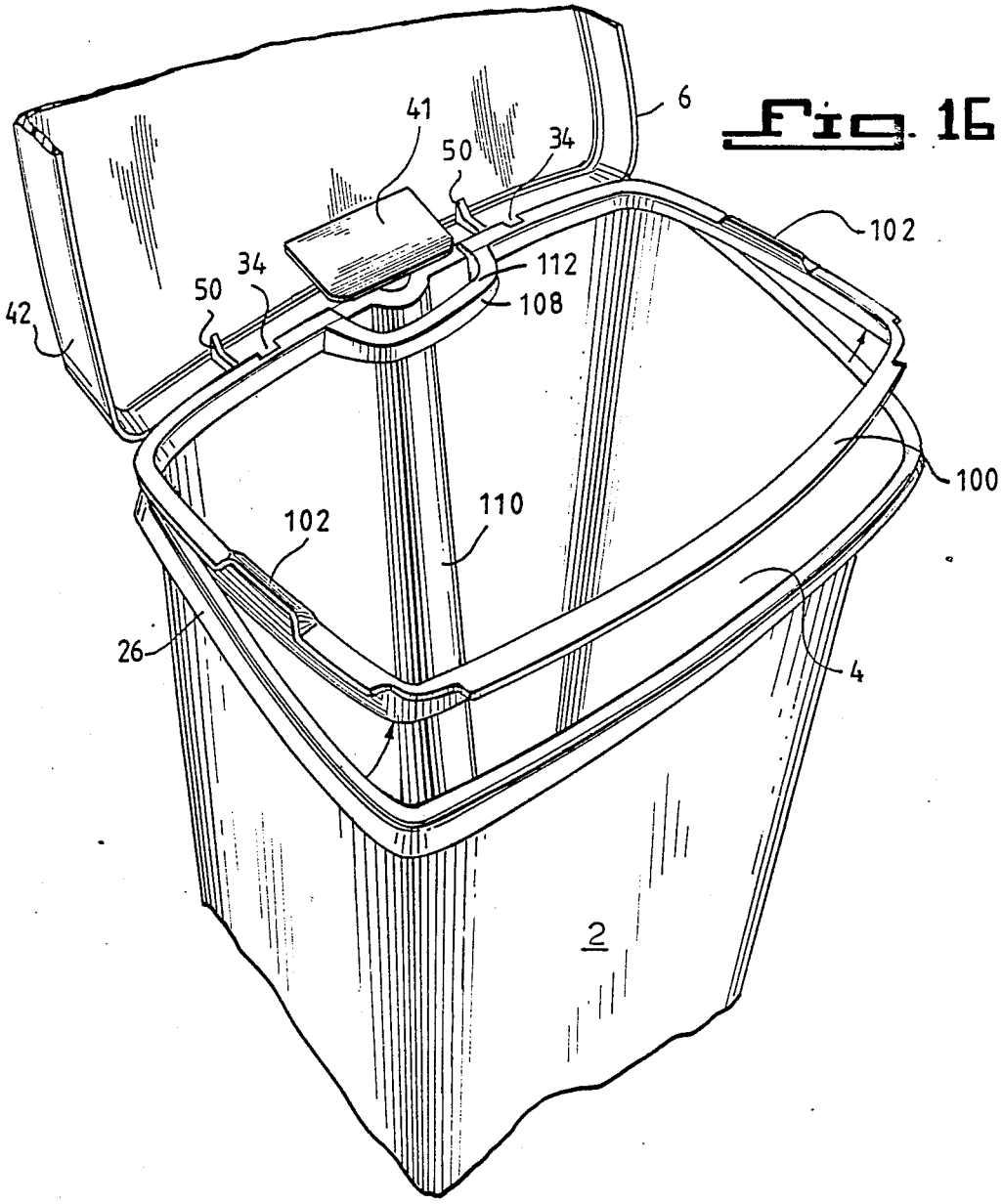
FIG. 16 is a perspective view of an alternative embodiment of the invention.
Figure 17:
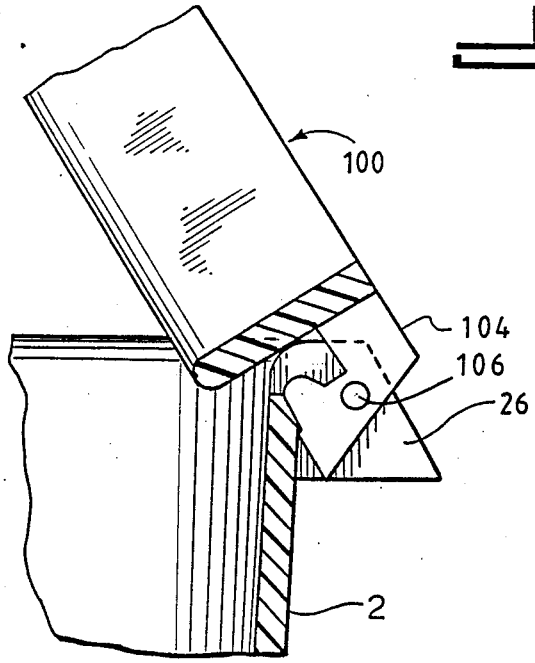
FIG. 17 is an enlarged, sectional view of hinge assembly for a retainer ring as shown in FIG. 16.
Figure 18:
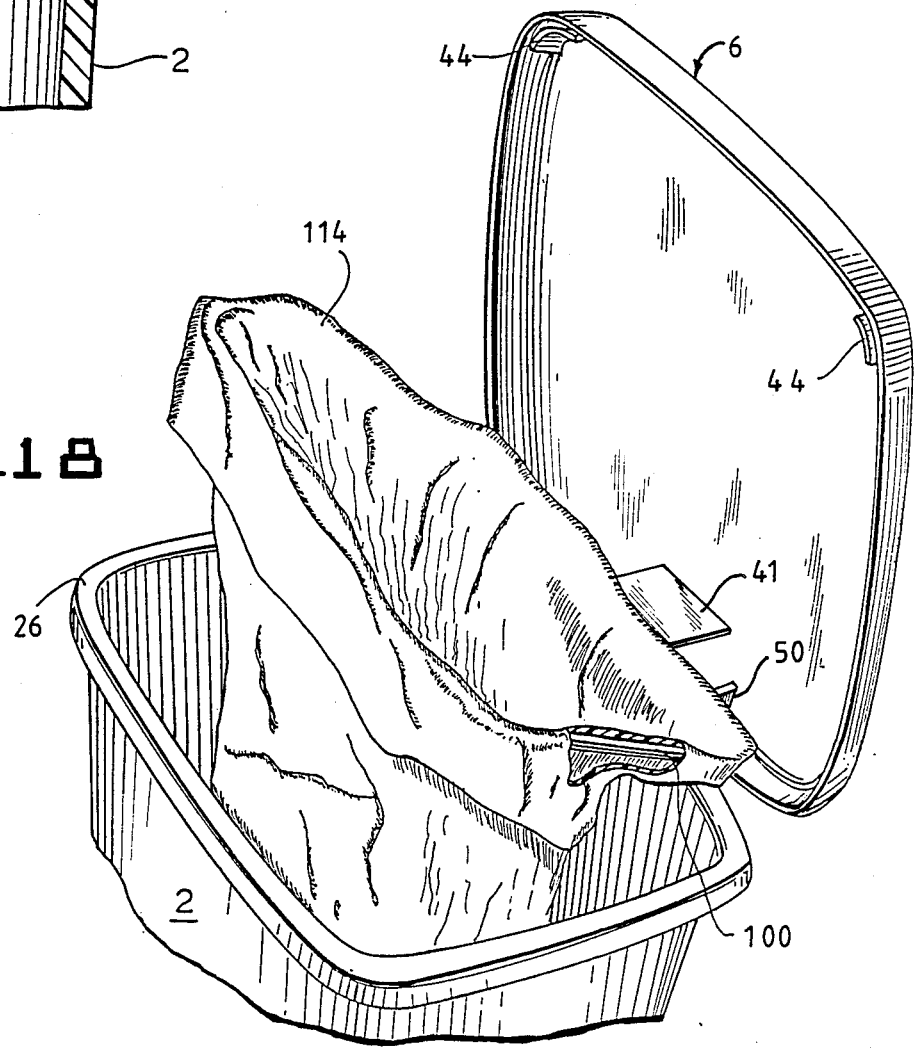
FIG. 18 is a perspective view of the wastebasket shown in FIG. 16 including a trash bag secured thereto.

Referring now to FIGS. 16–18, an alternative embodiment of the invention is shown. A similar construction is shown and described in detail in commonly assigned U.S. application Ser. No. 109,875 filed Oct. 19, 1987, now U.S. Pat. No. 4,753,367. The same numerals as employed in FIGS. 1–15 are used to designate similar elements.

The principal difference between the two illustrated embodiments is that the latter includes a retainer ring 100 which is pivotably mounted to the container 2. The ring includes a pair of integrally formed handles 102 and a pair of hinge elements 104 for securing it to the rim of the container. Each hinge element includes an aperture through which a cylindrical projection 106 extends.

As shown in FIG. 16, the retainer ring 100 includes an inwardly projecting rim portion 108. The longitudinal protrusion 110 defined by the rear wall of the container, which in turn defines the channel 32, extends within this projecting rim portion. The upper surface 112 of this portion slopes downwardly to allow the lid projection 41 to slide over it as the lid is closed or opened. The flat lid projection is about two inches in width A plastic liner 114 is mounted to the retaining ring 100 as shown in FIG. 18. The open end of the liner is folded over at least three quarters of the retaining ring. The projection 41, being in close proximity and preferably in contact with the container rim 26, does not allow the liner to be folded over the entirety of the rear rim portions of either the retaining ring or the container. It accordingly is prevented from interfering with the operation of the lid hinge mechanism or actuating assembly.

Although illustrative embodiments of the present invention the have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A wastebasket, which comprises:

a container having a top rim defining a top opening formed therein;

a lid pivotally mounted on the container and adapted to pivot about a pivot axis to cover and uncover the top opening; said lid including a top surface and a bottom surface;

means for pivotally mounting the lid to the container;

means for maintaining said lid in an open and substantially upright position with respect to said container;

means for actuating pivotal movement of the lid with respect to the container between positions covering and uncovering the top opening, the lid movement actuating means including a generally horizontal operating lever mounted on the container at the lower portion thereof, and link means operatively interconnecting the operating lever and said lid; and a projection extending from said bottom surface of said lid, said projection extending at least partially over said top rim of said container and said link means when said lid is in said open substantially upright position.

2. A wastebasket as defined in claim 1 wherein said projection is adjacent to said top rim of said container when said lid is in said open, substantially upright position.

3. A wastebasket as defined in claim 2 wherein said projection is in contact with said top rim of said container when said lid is in said open, substantially upright position.

4. A wastebasket as defined in claim 2 wherein said projection has a substantially flat, planar configuration.

5. A wastebasket as defined in claim 1 including a retaining ring pivotably mounted to said container, said retaining ring having substantially the same length and width as said top rim of said container.

6. A wastebasket as defined in claim 5 wherein said retaining ring includes a projecting portion extending within said top rim of said container.

7. A wastebasket as defined in claim 6 wherein said projecting portion of said retaining ring includes an upper surface which slopes downwardly with respect to said top rim of said container.

8. A wastebasket s defined in claim 6 wherein said projection is in contact with said top rim of said container when said lid is in said open, substantially upright position.

9. A wastebasket as defined in claim 8 wherein said projection has a substantially flat, planar configuration.

10. A wastebasket as defined in claim 5 wherein said projection is adjacent to said top rim of said container when said lid is in said open, substantially upright position.

11. A wastebasket as defined in claim 8 wherein said projection is in contact with said top rim of said container when said lid is in said open, substantially upright position.

12. A wastebasket as defined in claim 10 wherein said projection has a substantially flat, planar configuration.

* * * * *